US007883346B2

(12) United States Patent
Huang

(10) Patent No.: US 7,883,346 B2
(45) Date of Patent: Feb. 8, 2011

(54) SUPPLY HUB SAFETY SHIELD

(76) Inventor: Huadao Huang, No. 306 Jiaotong Road West, Baixiang Town, Yueqing City, Zhejiang Province (CN) 325603

( * ) Notice: Subject to any disclaimer, the term of this patent is extended or adjusted under 35 U.S.C. 154(b) by 0 days.

(21) Appl. No.: 12/768,394

(22) Filed: Apr. 27, 2010

(65) Prior Publication Data

US 2010/0317209 A1 Dec. 16, 2010

(30) Foreign Application Priority Data

Jun. 10, 2009 (CN) ..... 2009 2 0149748 U

(51) Int. Cl.
*H01R 13/44* (2006.01)

(52) U.S. Cl. ..... 439/140

(58) Field of Classification Search ..... 439/140, 439/135, 137, 139, 143, 145
See application file for complete search history.

(56) References Cited

U.S. PATENT DOCUMENTS 3,990,758 A * 11/1976 Petterson ..... 439/138
5,006,075 A * 4/1991 Bowden, Jr. ..... 439/137
6,555,771 B2 * 4/2003 Shao ..... 200/51 R
7,179,992 B1 * 2/2007 Packard et al. ..... 174/53
7,637,756 B1 * 12/2009 Hsu ..... 439/145

* cited by examiner

*Primary Examiner*—Tho D Ta
*Assistant Examiner*—Travis Chambers
(74) *Attorney, Agent, or Firm*—Mei & Mark LLP

(57) ABSTRACT

A supply hub safety shield device for a power socket comprises left and fight slide blocks comprising sloped shields and platform shields. A slide platform is configured to house the left and right slide blocks such that the left and right slide blocks slide along a surface of the slide platform. The slide platform comprises first and second perforations configured to receive a hot blade and a neutral blade of an attaching plug. First and second elastic components push against the left and right slide blocks. Position blocks in a middle position of the slide platform, are configured to receive surfaces of the elastic components and are further configured to limit sliding distances of the left and fight slide blocks. First and second perforations are under the sloped shields when the sloped shields are in initial positions.

12 Claims, 5 Drawing Sheets

SUPPLY HUB SAFETY SHIELD

This application claims the benefit of priority of Chinese patent application 200920149748.2, filed Jun. 10, 2009, the contents of which are incorporated herein by reference in their entirety.

TECHNICAL FIELD

The present disclosure relates generally to a supply hub shield device installed in a power socket that can prevent the occurrence of electric shock casualty accidents caused by false touching of the electric conductor in the supply hub of the power socket.

BACKGROUND

Safety is a primary factor considered by people when selecting household electrical products. At present, used often power sockets consist of a shell and two groups or three groups of conducting sheet metal installed in the shell. The conducting sheet metal may also be called a hot line output conductive plug bush group of a power supply, a neutral line output conductive plug bush group of a power supply, as well as a ground wire conductive plug bush group. Two-way or three-way supply hubs are set up on the surface of the power socket shell, and the conductive sheet metals described are set up under the supply hub. The conductive sheet metals are connected with the hot lines and neutral lines of the power supply as well as ground wires in a wall via conductive components and wires so that there is power supply output from the supply hub on the surface of the power socket.

The electrically live conductive sheet metal in the power socket is positioned under the hollow supply hub on the surface of the shell. In practical life some curious children put their finger in the supply hub, or touch the conductive sheet metal (conductive plug bush of the power supply output) under the supply hub with their finger or a metal bar. Once the children touch the conductive sheet metal in the supply hub, it can lead to the occurrence of an electric shock casualty accident, so it is very dangerous.

For the reasons mentioned above, Applicant proposes a supply hub safety shield device suitable for installation in a 5-20R standard American power socket. If the attaching plug is not inserted into the supply hub safety shield device of the supply hub, the supply hub safety shield device will cover the I shaped output conductive plug bush of the hot line of the power supply and the T shaped output conductive plug bush of the neutral line of the power supply. The supply hub safety shield will prevent the occurrence of electric shock casualty accidents effectively caused by carelessness or the putting of a finger or a metal bar in a supply hub. When the attaching plug is inserted into the supply hub forcibly, the supply hub safety shield device acts under the function of the attaching plug blade and moves with the compression of attaching plug blade. This exposes the T shaped and I shaped output conductive plug bushes of the neutral line and hot line of the power supply to make the attaching plug insert into the 5-20R standard socket.

The utility model provides a kind of supply hub safety shield device installed in a power socket. If the attaching plug is not inserted into the power socket, the supply hub safety shield device of the supply hub covers the conductive sheet metal beneath it. The supply hub safety shield device will prevent the occurrence of electric shock casualty accidents effectively caused by carelessness or the putting of a finger or metal bar in a supply hub. When the attaching plug is inserted into the supply hub forcibly, the supply hub safety shield device acts under the function of the attaching plug blade and moves with the compression of attaching plug blade. This motion exposes the conductive plug bush of the power output to make the attaching plug insert into the power socket.

Because the supply hub safety shield devices are installed between the hot line and neutral line output jacks of the power supply on the surface of the power socket and the hot line and neutral line output conductive plug bushes of the power supply, when the attaching plug is not inserted into the power socket the supply hub safety shield device covers the hot line and neutral line output conductive plug bushes of the power supply under it. Various power supply output jacks on the surface of the power socket are under the closed and protected state. The attaching plug is unable to see or touch the hot line or neutral line output conductive plug bushes of the power supply from the top cover of power socket. Even if people put their finger or a conductive sheet metal in the supply hub carelessly or out of curiosity, they can not touch the live output conductive plug bush of the neutral line of the power supply and the output conductive plug bush of the neutral line of the power supply. The power socket will not lead to the occurrence of electric shock casualty accidents. When the attaching plug is inserted into the supply hub on the surface of the power socket, the supply hub safety jacks shield device in the socket acts under the function of the attaching plug blade to expose the conductive plug bush of the power output under it so as to make the attaching plug insert into the power socket. After the attaching plug is drawn out from the power socket, the supply hub safety jack shield device returns to the initial position under the function of the elastic components in the supply hub safety jack shield device to cover the hot line and neutral line output conductive plug bushes under it. The various power supply output jacks on the surface of the power socket are restored to the closed and protected state. The supply hub safety shield device will prevent the occurrence of electric shock casualty accidents effectively caused by carelessness or putting a finger or metal bar in a supply hub out of curiosity, and it is very safe.

SUMMARY

A supply hub safety shield device of one embodiment is for installation in a power socket. The power socket comprises a hot line output conductive plug bush for receiving an electrical connection from a hot line of a power supply and a neutral line output conductive plug bush for receiving an electrical connection from a neutral line of the power supply. The power socket receives an attaching plug of an electrical appliance.

The supply hub safety shield device comprises a left slide block comprising at least a first sloped shield and a first platform shield and a right slide block comprising at least a second sloped shield and a second platform shield. A slide platform is configured to house the left slide block and the right slide block such that the left slide block and the right slide block are configured to slide along a surface of the slide platform. The slide platform comprises a first perforation configured to receive a hot blade of the attaching plug, and a second perforation configured to receive a neutral blade of the attaching plug. A first elastic component is configured to push against the left slide block and a second elastic component is configured to push against the right slide block. A first position block in a first middle position of the slide platform is configured to receive a surface of the first elastic component and is further configured to limit a sliding distance of the left slide block. A second position block in a second middle position of the slide platform is configured to receive a surface of the second elastic component and is further configured to limit a sliding distance of the right slide block.

The first perforation is under the first sloped shield when the first sloped shield is in the first initial position and is configured to be over the hot line output conductive plug bush of the hot line of the power supply when the device is installed in the power socket. The second perforation is under the second sloped shield when the second sloped shield is in the initial position and is configured to be over the neutral line output conductive plug bush of the neutral line of the power supply when the device is installed in the power socket.

The first elastic component is between the first position block and an inside wall of the left slide block, and the second elastic component is between the second position block and an inside wall of the right slide block.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

FIGS. 2-1 is a structure diagram of example 1.

FIGS. 2-2 is an exploded structure diagram of the implementation example 1 of the utility mode;

FIGS. 3-1 is a structure diagram of example 2.

FIGS. 3-2 is an exploded structure diagram of the example shown in FIG. 3-1.

DETAILED DESCRIPTION

Figure 1:
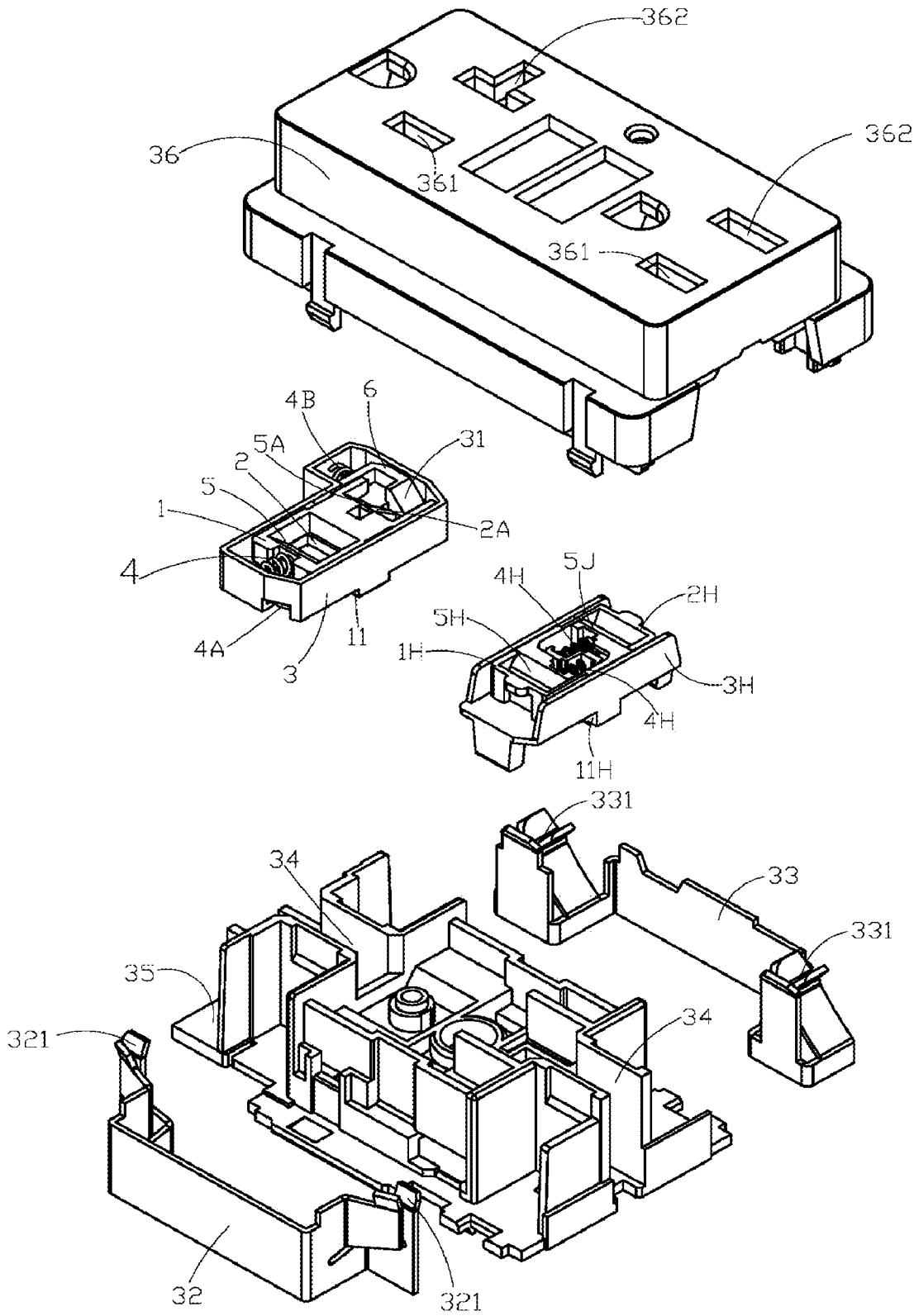
FIG. 1 is an example of an exploded structure diagram of the power socket in which the supply hub safety shield is installed.

Reference will now be made in detail to the present exemplary embodiments, examples of which are illustrated in the accompanying drawings. Wherever possible, the same reference numbers will be used throughout the drawings to refer to the same or like parts.

Further and detailed description of the structure and advantages of the invention is made through the following combined attached drawings and the implementation examples, which have no restriction whatsoever on the invention. In order to facilitate the description, the parts of a T shaped hole corresponding to the shape and direction of an I shaped hole are referred to as longitudinal, and the parts vertical to the direction of an I shaped hole are referred to as transverse. Moreover, such words expressing the directions "up", "down", "forward" and "backward" and so on are applied to describe the corresponding directions shown in the drawings and are not for the purpose of restriction.

In order to prevent occurrence of electric shock casualty accidents effectively caused by false touching of the electric conductor in the supply hub on the surface of a power socket, the inventor designed the supply hub safety shield device installed in a power socket. Examples are shown in FIGS. 2-1 and 3-1.

As shown in FIG. 1, the hot line output jack 361 and the neutral line output jack 362 of the power supply on the surface of power socket is above the supply hub safety shield device and the hot line output conductive plug bush 321 and neutral line output conductive plug bush 331 of the power supply are below the supply hub safety shield device. Hot line output conductive plug bushes 321 are associated with hot line bracket 32, and neutral line output conductive plug bushes 331 are associated with hot line bracket 33. If the attaching plug is not inserted into the power socket, the supply hub safety shield device covers hot line output conductive plug bush 321 and neutral line output conductive plug bush 331 under it. Various supply hubs are under the closed and protected state. The attaching plug or a user are unable to see or touch the hot line or neutral line output conductive plug bushes 321 and 331 from the hot line and neutral line output jacks 361 and 362. Even if children or an adult touches the supply hub or touches the supply hub by a metal bar carelessly, they are unable to move the supply hub safety jack shield device. The touching will not lead to electric shock casualty accidents and it is very safe. When the attaching plug is inserted into the power socket forcibly, the supply hub safety shield device acts and the shields and sloped shield of the supply hub safety shield devices are moved with the insertion of the attaching plug. The hot line and neutral line output conductive plug bushes 321 and 331 under the supply hub safety shield device are exposed. The attaching plug is inserted into the power socket and there is power supply through the attaching plug. When the attaching plug is drawn out of the power socket, the shields and sloped shields in the supply hub safety shield devices restore to their initial positions and are under the function of a spring or elastic sheet metal, so that the hot line and neutral line output conductive plug bushes under them are covered. The various supply hubs are under a closed and protected state. A user or attaching plug are unable to see or touch the output conductive plug bushes of the hot line or neutral line of the power supply from the hot line and neutral line output jacks on the surface of power socket. Even if children or adults touch the supply hub or touch the supply hub by metal bar carelessly, the touching will neither touch the electric conductors in the jack nor lead to the electric shock casualty accidents, so it is very safe.

Figure 2:
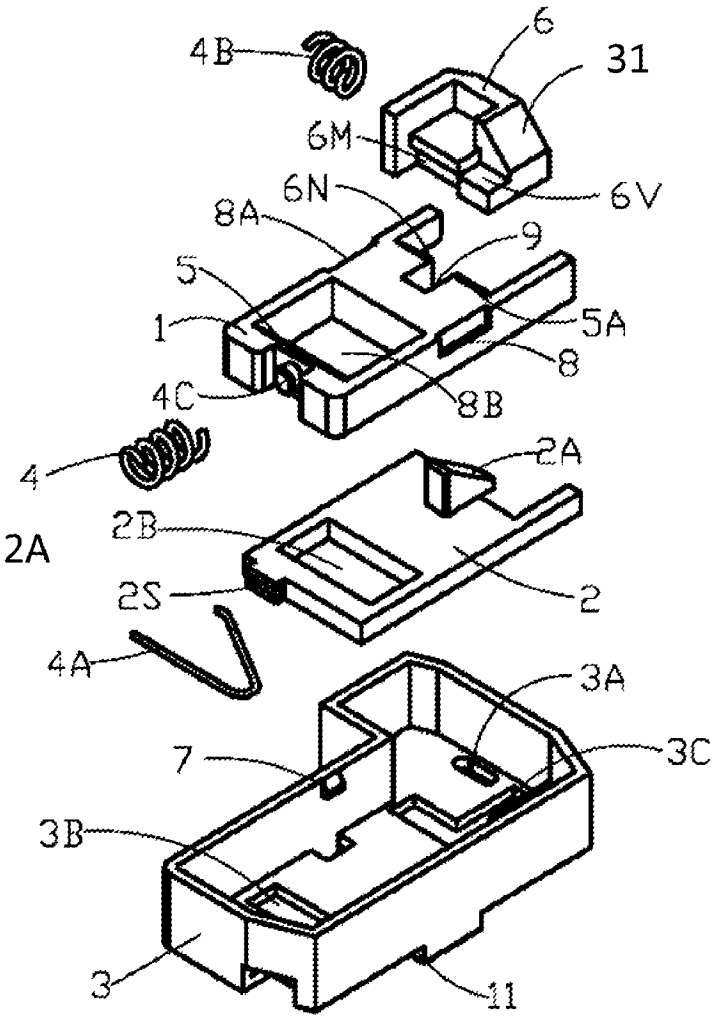
Figures 1, 2:
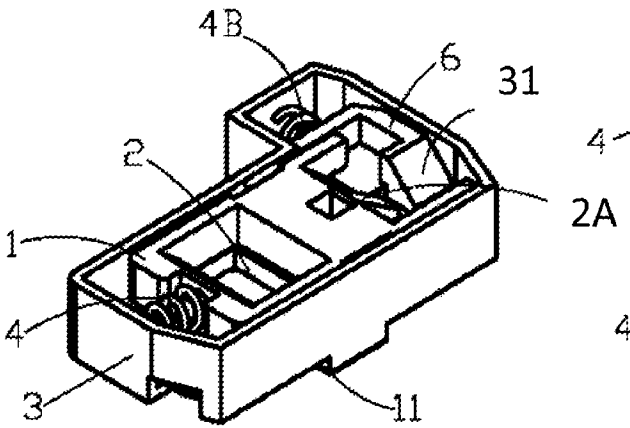
Figures 2, 3:
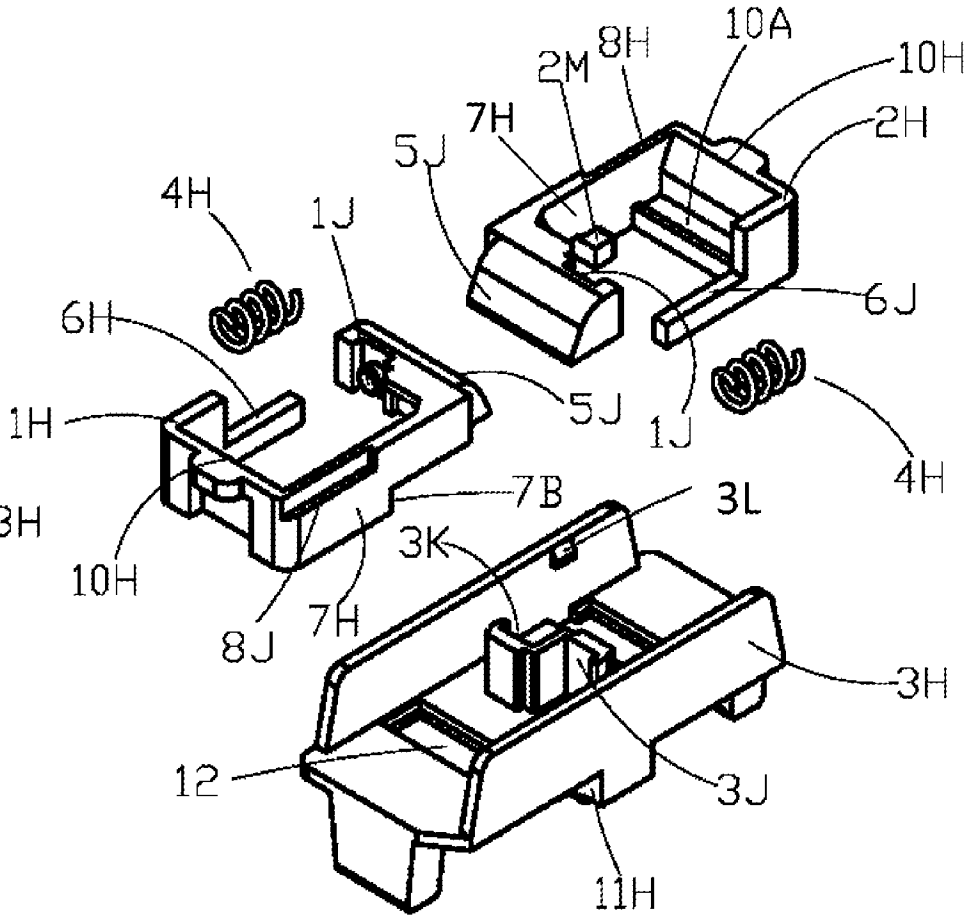
Figures 1, 3:
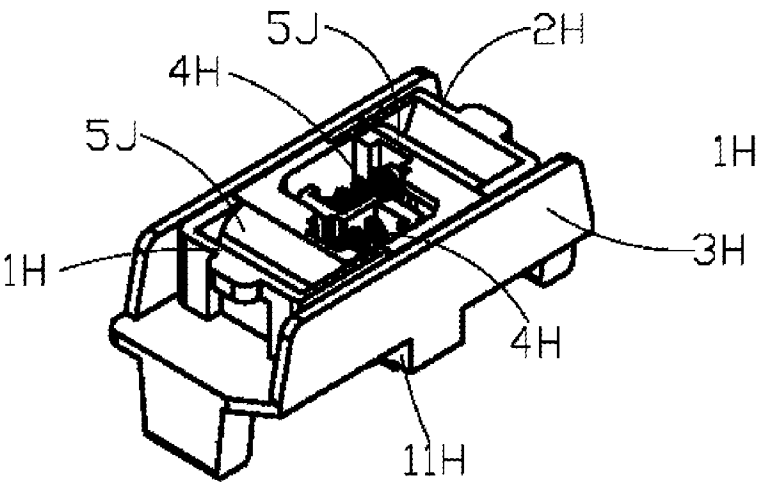

FIGS. 2-1 and 2-2 are structure diagrams of an implementation example 1. As shown in FIGS. 2-1 and 2-2, the supply hub safety shield device installed in a power socket comprises an upper shield 1, lower shield 2, small shield 6, base box 3 and first, second and third elastic components 4, 4A and 4B. The upper shield 1 is placed on the lower shield 2 and the small shield 6 is place at the notch-shaped side of the upper shield 1 and lower shield 2. After the upper shield 1, lower shield 2 and small shield 6 are combined, they are held in base box 3. First, second, and third elastic components 4, 4A and 4B are placed between the upper shield 1, lower shield 2 and small shield 6 respectively.

As shown in FIGS. 2-1 and 2-2, I shaped hole 3B and T shaped hole 3 C, corresponding to the shape of a supply hub on the surface of a power socket, are set up on the surface of base box 3. Long hole 3A cooperates with a column to make the small shield 6 slide along the surface of the base box 3 and is set up on the surface of base box 3 and under the small shield 6. There is a column set up under the small shield 6 and the column is inserted into the long hole 3A on the surface of base box 3, and the small shield 6 can move forward and backward along the long hole 3A.

The upper shield 1, lower shield 2 and small shield 6 can slide along base box 3, so that I shaped hole 3B and T shaped hole 3C on the surface of base box 3 can be exposed.

Lower shield 2 is place on base box 3. A first hole 2B is set up at the position corresponding to I shaped hole 3B on the surface of base box 3 and a fixed groove 2S is used for fixing the second elastic component 4A. The other end of the lower shield 2 is in a notch shape and a bump 2A with a slope is set up at its edge.

Upper shield 1 is placed over the lower shield 2. A second hole 8B is set up at one end of the upper shield 1 and above the I shaped hole 3B of base box 3 and there is a first sloping block 5 with a slope set up at the inner side of hole 8B. First sloping block 5 covers the I shaped hole 3B of base box 3 under it. The other end of upper shield 1 is in a notch shape and a second sloping block 5A with an inclined plane is set up inside the notch and in the same direction and in parallel to first sloping block 5. A bump groove 9 is set up at one end of the notch of upper shield 1 to hold bump 2A on lower shield 2.

Small shield 6 is placed at the notch of upper shield 1 and over T shaped hole 3C on the surface of base box 3. Third sloping block 31 has an inclined plane, is in parallel to I shaped hole 3B, and is set up at one end of the small shield 6. A platform 6V is also included.

A side groove 6M is formed at the side of small shield closest to upper shield 1. The short side of notch shape 6N of upper shield 1 is inserted into the side groove 6M. If the attaching plug is not inserted into supply hub, the short side of notch shape 6N is inserted into side groove 6M of small shield 6 so as to lock upper shield 1 and small shield 6 together. If the attaching plug is not inserted into the supply hub, first and second sloping blocks 5 and 5A on upper shield 1, bump 2A, and third sloping block 31 of small shield 6 will cover the I shaped hole 3B and T shaped hole 3C.

As shown in FIGS. 2-1, after the upper shield 1, lower shield 2 and small shield 6 are combined as a whole, they are held in base box 3. First elastic component 4, such as a spring, is placed between the upper shield 1 and a side wall of base box 3 and third elastic component 4B, such as a spring, is placed between the small shield 6 and side wall of base box 3. Second elastic component 4A, such as a sheet metal, is placed in fixed groove 2S and against base box 3.

When the upper shield 1, lower shield 2 and small shield 6 are in a dynamic sliding state, the first, second, and third elastic components 4, 4A, and 4B deform to accommodate the sliding motion of the upper shield 1, lower shield 2 and small shield 6. When the upper shield 1, lower shield 2 and small shield 6 transform from the dynamic sliding state to a static state, the first, second, and third elastic components 4, 4A, and 4B return to their natural shape to return the upper shield 1, lower shield 2 and small shield 6 to their initial positions.

The upper shield 1, after combined with lower shield 2 and base box 3, cooperates with the retaining bump 7 on the side wall of base box 3 through first and second base box grooves 8 and 8A on the side wall of upper shield 1. This fixes upper shield 1 and lower shield 2 in base box 3.

As shown in FIGS. 1, 2-1 and 2-2, the supply hub safety shield device, after combined, is placed between top cover 36 and middle frame 35 of power socket. When the attaching plug is pushed downward into the power socket forcibly, T shaped blade on the attaching plug touches at first the bump 2A with inclined slope on lower shield 2 and the third sloping block 31 with a slope on small shield 6. When the attaching plug is pushed downward into the power socket forcibly, T shaped blade on attaching plug presses the slopes of bump 2A and third sloping block 31, to move the lower shield 2 to the left. Small shield 6 moves upwards to expose the T shaped hole 3C on base box 3. At the same time, I shaped blade on the attaching plug touches and presses the first and second sloping blocks 5 and 5A on the upper shield 1 to push the upper shield 1 to slide along the surface of base box 3, so as to expose I shaped hole 3B and T shaped hole 3C on base box 3. The blade on attaching plug inserts into output conductive plug bushes of the power supply under base box 3, and now there is power supply through the attaching plug.

During the inserting of the attaching plug into the power socket, the upper shield 1, lower shield 2 and small shield 6 are pushed to move and compress the first, second, and third elastic components 4, 4A and 4B. After the attaching plug is drawn out of the power socket, upper shield 1, lower shield 2 and small shield 6 return to their original position under the function of first, second, and third elastic components 4, 4A and 4B to cover I shaped hole 3B and T shaped hole 3C on base box 3 under them.

Upper shield 1, lower shield 2, small shield 6 and first, second and third elastic components 4, 4A, and 4B in the implementation of example 1 are combined together and held in the base box. The upper shield 1, lower shield 2, and small shield 6 are electrically insulating parts.

FIGS. 3-1 and 3-2 are the structure diagrams of implementation example 2. As shown in FIGS. 1, 3-1 and 3-2, the supply hub safety shield device consists of the left slide block 1H, right slide block 2H, slide platform 3H and slide block elastic components 4H.

The left slide block 1H is positioned under the hot line jack and is composed of the sloped shield 5J, side shield 10H, cross beam 7H and sliding beam 6H. The right slide block 2H is positioned under the neutral line jack and is also composed of the sloped shield 5J, side shield 10H, cross beam 7J and sliding beam 6H.

The sloped shield 5J is in parallel to side shield 10H and its inclined plane extends towards the side shield 10H and a certain distance is kept between them. Sloped shield 5J and side shield 10H are vertical to cross beam 7H and are connected together through cross beam 7H. The width of sloped shield 5J is approximately equal to that of the jack of the neutral line on the surface of the power socket.

A shield platform 10A extends inwards at the inner side of the side shield 10H.

At the other end of the side shield 10H connecting with cross beam 7H, a sliding beam 6H, vertical to side shield 10H, extends outwards.

A sliding groove 7B is set up under the cross beam 7H and connected with sloped shield 5J and the depth and length of the sliding groove 7B can accommodate the sliding beam 6H of right slide block 2H. As shown in FIG. 1, when left slide block 1H and right slide block 2H are placed crosswise mutually, sliding beam 6H can insert in sliding groove 7B at the lower part of cross beam 7H of right slide block 2H.

A spring bump 1J is set up for fixing the slide block elastic component 4H, here a spring, on the inside wall of sloped shield 5J.

A limited block 2M is set up at the inner side of the cross beam 7H.

The right slide block 2H is positioned under the jack of the neutral line of the power socket and consists of sloped shield 5J, side shield 10H, cross beam 7H and sliding beam 6J, with the same structure as that of the left slide block 1H. Also, right slide block 2H consists of sloped shield 5J, side shield 10H, cross beam 7H and sliding beam 6J.

Sloped shield 5J is parallel to side shield 10H and its inclined plane extends back towards side shield 10H and a certain distance is kept between them. Sloped shield 5J and side shield 10H are vertical to cross beam 7H and are connected together through cross beam 7H. The width of sloped shield 5J is approximately equal to that of the jack of the hot line.

At the other end of side shield 10H connecting with cross beam 7H, a sliding beam 6J, vertical to side shield 10H, extends outwards.

A sliding groove 7B is set up under the cross beam 7H and connects with sloped shield 5J and the depth and length of the sliding groove 7B can accommodate the sliding beam 6H of left slide block 1H. As shown in FIG. 1, when left slide block 1H and right slide block 2H are placed crosswise mutually, sliding beam 6J can insert in to sliding groove 7B at the lower part of cross beam 7H of left slide block 1H.

A shield platform 10A extends inwards at the inner side of the side shield 10H of right slide block 2H.

A spring bump 1J is also set up for fixing the slide block elastic component 4H, shown as a spring, on the inside wall of sloped shield 5J of right slide block 2H.

When left slide block 1H and right slide block 2H are in a dynamic sliding state, slide block elastic components 4H deform to accommodate the sliding motion of left slide block 1H and right slide block 2H. When left slide block 1H and right slide block 2H transform from the dynamic sliding state to a static state, slide block elastic components 4H return to their natural shape to return left slide block 1H and right slide block 2H to their initial positions.

As shown in FIGS. 3-1 and 3-2, two perforations 12 on the surface of slide platform 3H, with the same shape and dimension as that of jacks of the neutral line and the hot line, are set up on the surface of slide platform 3H. The two perforations 12 are positioned under the sloped shields 5J of left slide block 1H and right slide block 2H and are positioned over the output conductive plug bushes of the hot line and neutral line of the power supply in the power socket. If the attaching plug is not inserted into the power socket, the shield platform 10A of sloped shield 5J and side shield 10H of left slide block 1H and right slide block 2H extends inwards and covers the two perforation 12 on the surface of the slide platform 3H.

The first and second position blocks 3K and 3J are used for fixing the slide block elastic component 4H and for limiting the sliding distance of left slide block 1H and right slide block 2H. First and second position blocks 3K and 3J are set up in the middle of the slide platform 3H. After left slide block 1H and right slide block 2H are placed on slide platform 3H crosswise, the slide block elastic components 4H are set up between first position block 3K and spring bump 1J of left slide block 1H and between second position block 3J and spring bump 1J of right slide block 2H.

When left slide block 1H and right slide block 2H are sliding on the slide platform 3H, the first and second position blocks 3K and 3J may prevent them from sliding out of the platform. At the same time, when the attaching plug is drawn out of the power socket, the slide block elastic components 4H set up between left and right slide blocks 1H and 2H and first and second position blocks 3K and 3J may cause the left and right slide blocks 1H and 2H to return to their initial position rapidly.

Fixed column 11H extends out under slide platform 3 and its function is to fix slide platform 3H in the channel portion 34 of middle frame 35 of the power socket.

Left slide block 1H, right slide block 2H and slide block elastic components 4H in example 2 are combined together and held in base box structure of slide platform 3H. Left slide block 1H and right slide block 2H cooperate with the retaining bump 3L on slide platform 3H through the first and second cross beam grooves 8J and 8H on the cross beam 7H and fix together with them.

Left slide block 1H, right slide block 2H and base box 3H are electrically insulating parts.

Figure 5:
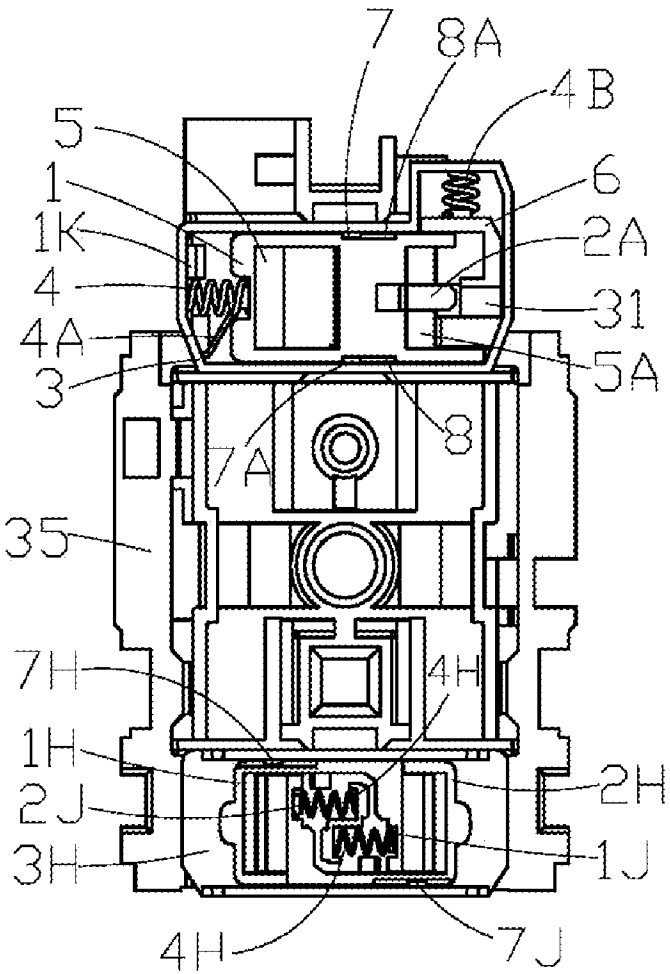
FIG. 5 is a second example comprising a combination of example 1 and example 2 installed in a power socket where the parts do not move and the conductive sheet metal below is covered.
Figure 4:
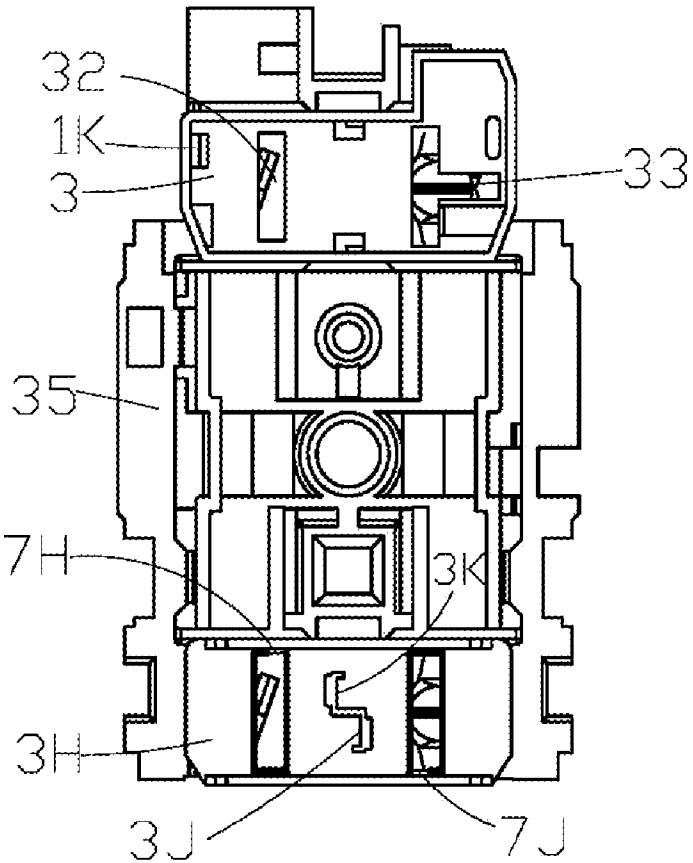
FIG. 4 is a first example of a base box comprising a combination of example 1 and example 2 installed in a power socket.
Figure 6:
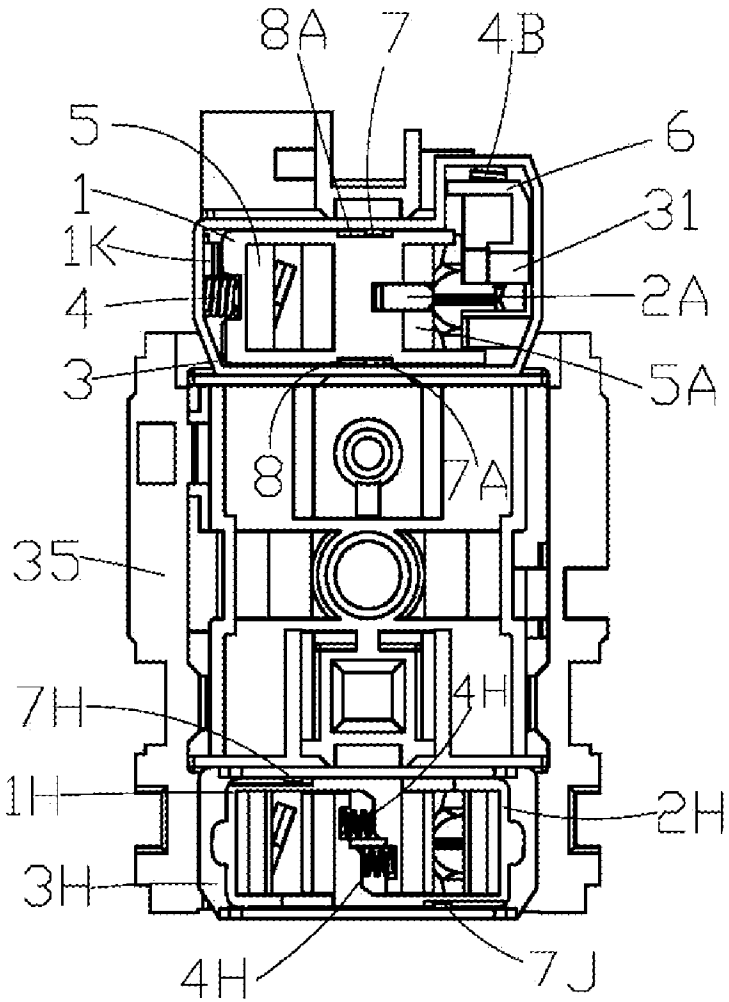
FIG. 6 is a third example comprising a combination of example 1 and example 2 installed in the power socket where the parts move and the conductive sheet metal below is exposed.

FIGS. 4 to 6 are internal structure diagrams of power sockets containing the supply hub safety shields of examples 1 and 2. The supply hub safety shield of FIGS. 2-1 and example 1 is installed in the upper part of the power socket, and the supply hub safety shield of FIGS. 3-1 and example 2 is installed in the lower part of the power socket.

In FIG. 4, base box 3 and base box of slide platform 3H are placed over middle frame 35 of the power socket so that I shaped hole 3B and T shaped hole 3C are positioned over the hot line and neutral line output conductive plug bushes 321 and 331. This is done before sticking the first and second fixed columns 11 and 11H of base box 3 and base box of slide platform 3H in channel portion 34 of middle frame 35 as shown in FIG. 1.

FIG. 5 is the structure diagram to have the upper shield 1, lower shield 2, small shield 6 and first, second and third elastic components 4, 4A, and 4B of example 1 held in the base box 3. Also left slide block 1H, right slide block 2H and the slide block elastic components 4H of example 2 are placed in the base box of slide platform 3H. As shown in the upper part of FIG. 5, when the attaching plug is not inserted into the supply hub the upper shield 1, lower shield 2 and the third sloping block 31 of small shield 6 cover the neutral and hot line output conductive plug bushes 362 and 361. Various supply hubs are under the closed and protected state. The attaching plug and a user are unable to see or touch hot line or neutral line output conductive plug bushes 361 and 362 from the hot line or neutral line output jacks on the surface of the power socket. Even if children or adults touch the supply hub or touch the supply hub by a metal bar carelessly, they will neither touch the electric conductor nor lead to the electric shock casualty accident, so it is very safe.

As shown in the lower part of FIG. 5, when the attaching plug is not inserted into the supply hub, because sloped shields 5J of left slide block 1H and right slide block 2H cover the hot line and neutral line output conductive plug bushes 361 and 362. So, various supply hubs are under the closed and protected state, and the attaching plug or users are unable to see or touch the hot line or neutral line output conductive plug bushes from the hot line or neutral line output jack on the surface of the power socket. Even if children or adults touch the supply hub or touch the supply hub by a metal bar carelessly, they will neither touch the electric conductor nor lead to an electric shock casualty accident, so it is very safe.

As shown in the upper part of FIG. 6, when the attaching plug is inserted into the power output jack on the surface of the power socket forcibly, upper shield 1, lower shield 2, and small shield 6 glide along the base box under the function of I shaped blade and T shaped blade of the attaching plug. In the process of the glide, T shaped hole and I shaped hole on the base box are exposed, so that the hot line and neutral blades on attaching plug pass through the base and insert into hot line and neutral line output conductive plug bushes under them. The attaching plug is inserted into the power socket completely and there is power output.

As shown in the lower part of FIG. 6, when the attaching plug is inserted into the power output jack on the surface of power socket forcibly, left slide block 1H and right slide block 2H glide along the base box under the function of the blades of the attaching plug. In the process of the glide, T shaped hole and I shaped hole on the base box are exposed, so that hot line and neutral blades on the attaching plug pass through the base and insert into hot line and neutral line output conductive plug bushes under them. Then the attaching plug is inserted into the power socket completely and there is power output under the function of the blade of the attaching plug.

When the attaching plug is drawn out of the power socket, the shields and slide blocks restore to the initial positions under the function of the elastic components to cover the holes on the base. The various supply hubs are under the closed and protected state. Even if children or adults touch the supply hub or touch the supply hub by a metal bar carelessly, the touching will neither move the shields or slide blocks to expose the electric conductor under them nor lead to electric shock casualty accidents, so it is very safe.

The advantages are that: if the attaching plug is not inserted into the power socket, the supply hub safety jack shield device will cover I shaped holes and T shaped holes on the base, so as to cover the hot line and neutral line output conductive plug bushes of the power supply in the power socket. The various power output jacks on the surface of the power socket are under a closed and protected state. A user or object other than an attaching plug is unable to see or touch the hot line or neutral line output conductive plug bushes from the top cover of the power socket and is unable to move the supply hub safety shield devices to expose the hot line or neutral line output conductive plug bushes. The supply hub safety shield devices will prevent effectively the occurrence of electric shock casualty accidents caused by false touching of the electric conductor in the supply hub on the surface of the power socket. It is very safe.

The contents described above are the preferred implementation examples of the utility model only and the protection range of the utility model is not limited to them. Any equivalent transformation based on the technical schemes of the utility model is under the protection of this disclosure.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. A supply hub safety shield device for a power socket comprising a hot line output conductive plug bush for receiving an electrical connection from a hot line of a power supply and a neutral line output conductive plug bush for receiving an electrical connection from a neutral line of the power supply, the power socket for receiving an attaching plug of an electrical appliance, the device comprising:

a left slide block comprising at least a first sloped shield and a first platform shield;

a right slide block comprising at least a second sloped shield and a second platform shield;

a slide platform configured to house the left slide block and the right slide block such that the left slide block and the right slide block are configured to slide along a surface of the slide platform, the slide platform comprising a first perforation configured to receive a hot blade of the attaching plug, and a second perforation configured to receive a neutral blade of the attaching plug;

a first elastic component configured to push against the left slide block;

a second elastic component configured to push against the right slide block;

a first position block in a first middle position of the slide platform, the first position block configured to receive a surface of the first elastic component and further configured to limit a sliding distance of the left slide block; and a second position block in a second middle position of the slide platform, the second position block configured to receive a surface of the second elastic component and further configured to limit a sliding distance of the right slide block, wherein:

the first perforation is under the first sloped shield when the first sloped shield is in the first initial position and is configured to be over the hot line output conductive plug bush of the hot line of the power supply when the device is installed in the power socket, the second perforation is under the second sloped shield when the second sloped shield is in the initial position and is configured to be over the neutral line output conductive plug bush of the neutral line of the power supply when the device is installed in the power socket, the first elastic component is between the first position block and an inside wall of the left slide block, and the second elastic component is between the second position block and an inside wall of the right slide block.

2. The device of claim 1, wherein the first elastic component pushes against the left slide block to maintain the left slide block in a first initial position and the second elastic component pushes against the right slide block to maintain the right slide block in a second initial position.

3. The device of claim 1, where the left slide block further comprises:

a first side shield; a first cross beam; a first sliding beam; and a first sliding groove, wherein:

the left slide block is configured to be positioned under a hot line jack of the power socket, the first sloped shield is parallel to the first side shield, a slope of the first sloped shield is inclined back towards the first side shield, the first sloped shield and the first side shield are a fixed distance apart, the first sloped shield and the first side shield are vertical to the first cross beam and are connected together by the first cross beam, the width of the first sloped shield is approximately equal to that of a hot line jack on a surface of the power socket, the first platform shield extends inwards at an inner side of the first side shield, the first sliding beam is vertical to the first side shield and extends outwards from an end of the first side shield that is connected with the first cross beam, the first sliding groove is set up under the first cross beam and connects with the first sloped shield, and the first sliding groove is configured to accommodate a sliding block of the right slide block.

4. The device of claim 3, where the right slide block further comprises:

a second side shield; a second cross beam; a second sliding beam; and a second sliding groove, wherein:

the right slide block is configured to be positioned under a neutral line jack of the power socket, the second sloped shield is parallel to the second side shield, the slope of the second sloped shield is inclined back towards the second side shield, the second sloped shield and the second side shield are a fixed distance apart, the second sloped shield and the second side shield are vertical to the second cross beam and are connected together by the second cross beam, the width of the second sloped shield is approximately equal to that of a neutral line jack on a surface of the power socket, the second platform shield extends inwards at an inner side of the second side shield, the second sliding beam is vertical to the second side shield and extends outwards from an end of the second side shield that is connected with the second cross beam, the second sliding groove is set up under the second cross beam and connects with the second sloped shield, and the second sliding groove is configured to accommodate the sliding block of the left slide block.

5. The device of claim 4, wherein, when the left slide block and the right slide block are in a dynamic sliding state, the first elastic component and the second elastic component deform to accommodate a sliding motion of the left slide block and the right slide block, and, when the left slide block and the right slide block transform from the dynamic sliding state to a static state, the first elastic component and the second elastic component return to their natural shape to return the left slide block and the right slide block to the first initial position and the second initial position.

6. The device of claim 5, further comprising:

a first bump on an inside wall of the first sloped shield; and a second bump on an inside wall of the second sloped shield, wherein:

the left slide block and the right slide block are set up mutually crosswise on the slide platform, the first bump fixes the first elastic component on the inside wall of the first sloped shield, and the second bump fixes the second elastic component on the inside wall of the second sloped shield.

7. The device of claim 6, wherein the first position block and the second position block are staggered with respect to each other and are parallel to the first and second elastic components.

8. The device of claim 7, wherein a elastic force of the first elastic component is equal to the elastic force of the second elastic component.

9. The device of claim 7, wherein, when an attaching plug is pressed against the first sloped shield and the second sloped shield, the first elastic component will compress towards the first position block, the second elastic component will compress towards the second position block, and the left slide block and the right slide block will move in opposite directions.

10. The device of claim 9, wherein the first elastic component is a spring and the second elastic component is a spring.

11. The device of claim 8, wherein, when an attaching plug is pressed against the first sloped shield and the second sloped shield, the first elastic component will compress towards the first position block, the second elastic component will compress towards the second position block, and the left slide block and the right slide block will move in opposite directions.

12. The device of claim 11, wherein the first elastic component is a spring and the second elastic component is a spring.

* * * * *